US005305292A

United States Patent [19]

Reynoso

[11] Patent Number: 5,305,292

[45] Date of Patent: Apr. 19, 1994

[54] FLUID FILLED WATCH APPARATUS

[76] Inventor: Daniel Reynoso, 85536 Ave. 52, Coachella, Calif. 92236

[21] Appl. No.: 993,367

[22] Filed: Dec. 18, 1992

[51] Int. Cl.[5] ..... G04B 45/00

[52] U.S. Cl. ..... 368/281; 368/282; 368/223; 368/228

[58] Field of Search ..... 368/281, 282, 223-239

[56] References Cited

U.S. PATENT DOCUMENTS 4,100,490 7/1978 Peck et al. ..... 368/114
4,364,670 12/1982 White ..... 368/114
4,382,700 5/1983 Youngren ..... 374/102
4,945,523 7/1990 Lam ..... 368/285
5,051,969 9/1991 Huang ..... 368/223
5,077,709 12/1991 Feher ..... 368/229

*Primary Examiner*—Bernard Roskoski
*Attorney, Agent, or Firm*—Leon Gilden

[57] ABSTRACT

A fluid filled watch includes a housing having a transparent housing lens, with watch hands mounted within a cavity of the watch containing a chemiluscent fluid. The fluid is arranged to provide for visual highlights within the watch during conditions of limited available light.

6 Claims, 4 Drawing Sheets

FLUID FILLED WATCH APPARATUS

BACKGROUND OF THE INVENTION

1. Field of the Invention

The field of invention relates to watch apparatus, and more particularly pertains to a new and improved fluid filled watch apparatus wherein the same is arranged to incorporate a chemiluscent fluid within the watch housing for visual amusement, entertainment, and ease of ascertainment of available time.

2. Description of the Prior Art

Watch structure of various types have been utilized throughout the prior art such as indicated in U.S. Pat. Nos. 4,945,523; 4,779,249; 4,028,377; and 3,635,402.

The instant invention attempts to overcome deficiencies of the prior art by providing for a watch containing a chemiluscent fluid for ease of ascertaining of available time and entertainment and amusement of individuals and in this respect, the present invention substantially fulfills this need.

SUMMARY OF THE INVENTION

In view of the foregoing disadvantages inherent in the known types of watch apparatus now present in the prior art, the present invention provides a fluid filled watch apparatus wherein the same is arranged to include a chemiluscent fluid contained within the lens cavity of the watch structure to further provide for the floating support of components within the watch cavity. As such, the general purpose of the present invention, which will be described subsequently in greater detail, is to provide a new and improved fluid filled watch apparatus which has all the advantages of the prior art watch apparatus and none of the disadvantages.

To attain this, the present invention provides a fluid filled watch including a housing having a transparent housing lens, with watch hands mounted within a cavity of the watch containing a chemiluscent fluid. The fluid is arranged to provide for visual highlights within the watch during conditions of limited available light.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office arid the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid filled watch apparatus which has all the advantages of -the prior art watch apparatus and none of the disadvantages.

It is another object of the present invention to provide a new and improved fluid filled watch apparatus which may be easily and efficiently manufactured and marketed.

It is a further object of the present invention to provide a new and improved fluid filled watch apparatus which is of a durable and reliable construction.

An even further object of the present invention is to provide a new and improved fluid filled watch apparatus which is susceptible of a low cost of manufacture with regard to both materials and labor, and which accordingly is then susceptible of low prices of sale to the consuming public, thereby making such fluid filled watch apparatus economically available to the buying public.

Still yet another object of the present invention is to provide a new and improved fluid filled watch apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
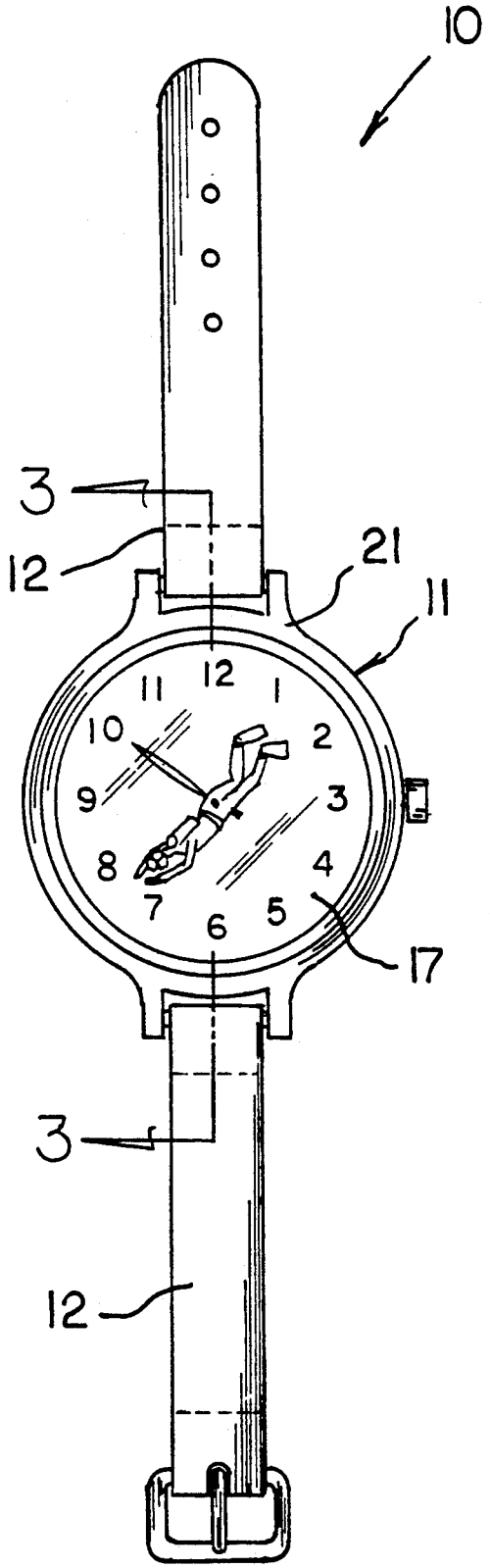
FIG. 1 is an orthographic top view of the invention.
Figure 2:
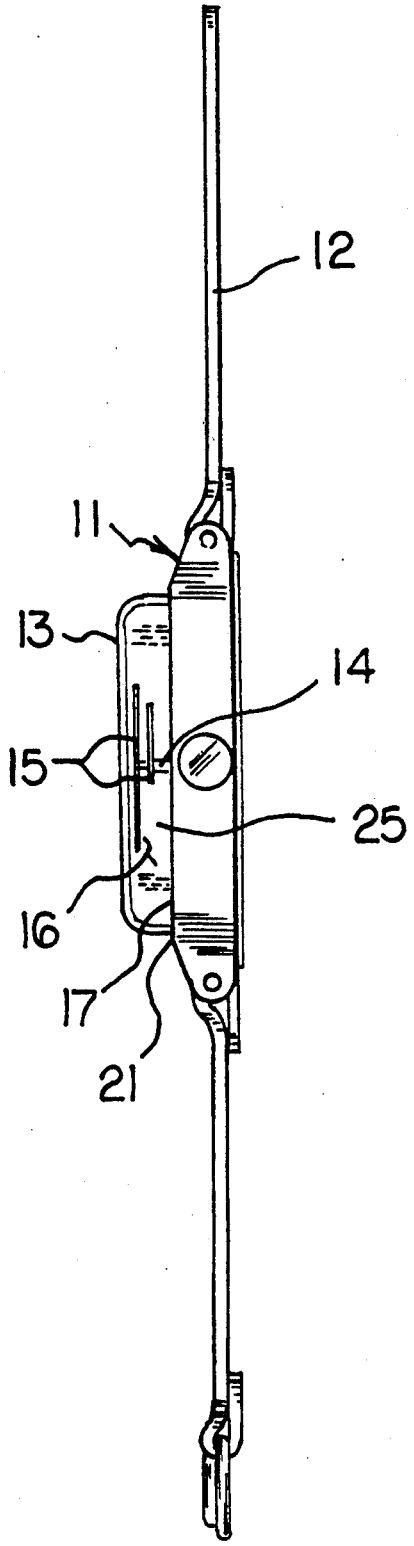
FIG. 2 is an orthographic side view of the invention.
Figure 3:
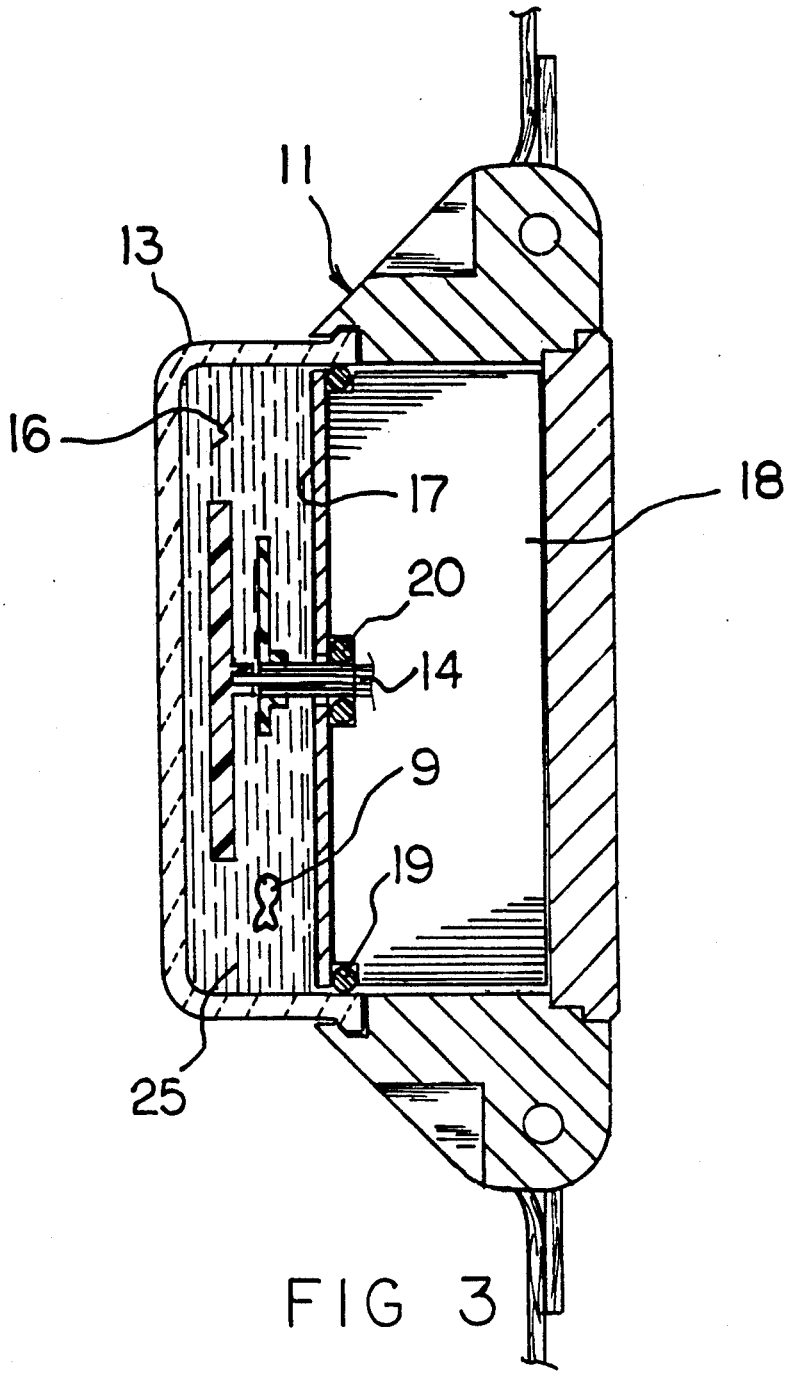
FIG. 3 is an orthographic side view, partially in section, of the watch structure of the invention.

With reference now to the drawings, and in particular to FIGS. 1 to 3 thereof, a view and improved fluid filled watch apparatus embodying the principles and concepts of the present invention and generally designated by the reference numeral 10 will be described.

Figure 4:
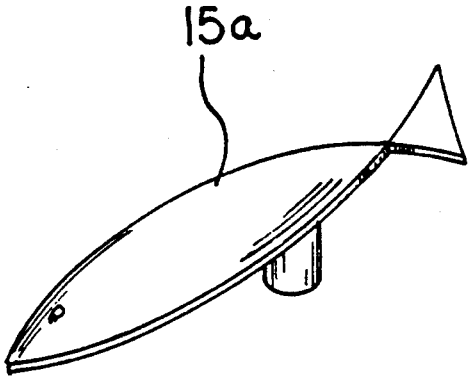
FIG. 4 is an isometric illustration of a modified watch hand structure of the invention.

More specifically, the fluid filled watch apparatus 10 of the instant invention essentially comprises a watch housing 11, including a plurality of securement straps 12 mounted to opposed sides of the watch housing for securement about an individual's wrist. The watch housing includes a housing top wall 21, including a transparent housing lens 13 mounted in relationship relative to the top wall 21 to employ an annular first seal 19. A watch face 17 is mounted to the housing top wall 21 within the transparent lens 13, with an output shaft 14 directed through the watch face 17, to include a plurality of indicator hands 15, as indicated, in any conventional manner employing a drive mechanism 18 (see FIG. 3) of any conventional types such as electrical, electric-quartz, mechanical, etc. The housing lens 13 over the watch face 17 defines a lens cavity 25, including a chemiluscent fluid 16 contained and filling the lens cavity 15. The chemiluscent fluid may be of any available type, such as indicated in U.S. Pat. Nos. 4,814,949 and 4,883,398 incorporated herein by reference by way of example. In this manner, visual ease of observation of the indicator hands 15 is available. The watch or indicator hands 15 may be of any desired configuration such as a modified hand structure 15*a*, as indicated in FIG. 4. Further, floating components may be directed within the fluid 16 within the cavity 25 for the entertainment and amusement of individuals, such as indicated by the numeral 9 in FIG. 3. Further, an annular second seal 20, as indicated in the FIG. 3, is provided in surrounding relationship relative to the output shaft 14 in communication with the drive mechanism 18 to prevent leakage of the fluid into the housing below the lens cavity 25.

Figure 6:
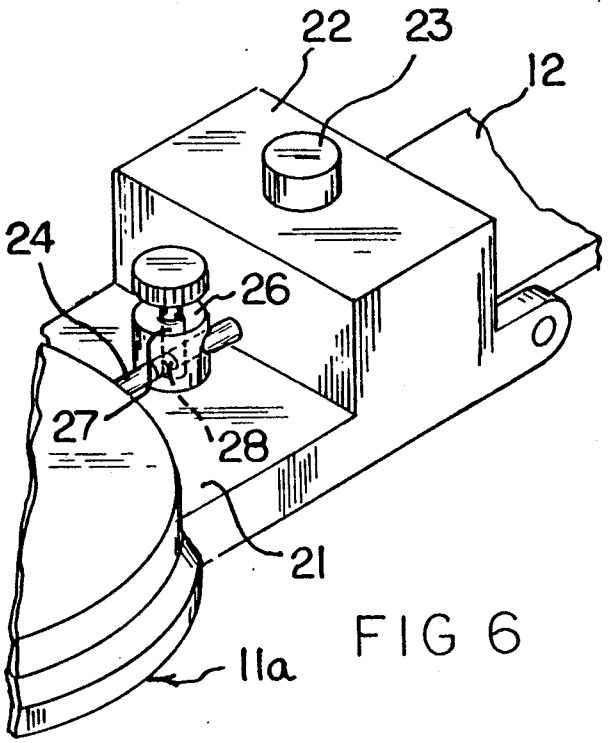
FIG. 6 is an isometric illustration of section 6—6 as indicated in FIG. 5 in the direction indicated by the arrows.
Figure 5:
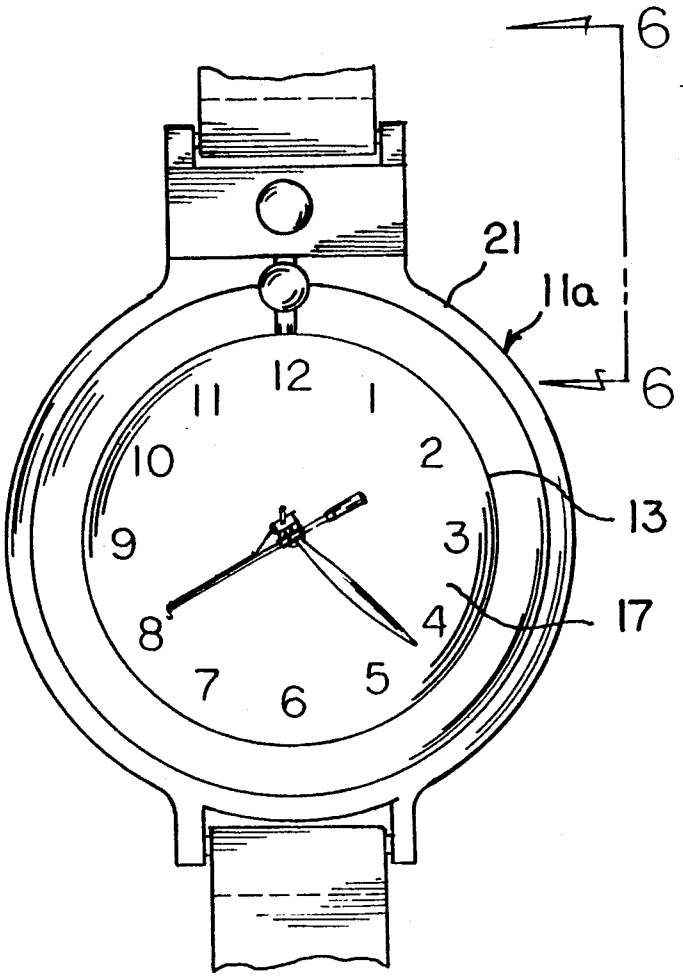
FIG. 5 is an orthographic top view of a modified aspect of the invention.

The FIGS. 5 and 6 indicates the use of a modified housing 11*a*, including a fluid reservoir 22 mounted to the top wall 21, including the chemiluscent fluid therewithin. In this manner, the lens cavity 25 may be selectively drained or replenished by an individual or the fluid changed to provide for fluids of various colorations within the lens cavity 25. The fluid reservoir 22 includes a reservoir fill cap 23 to provide replenishment or removal of fluid therefrom, with a float conduit 24 in fluid communication between the reservoir 22 and the lens cavity 25. A valve housing 26 is positioned medially of the float conduit 24, including a rotatable valve rod 27 having a valve rod bore 28 arranged for selective alignment with or displacement relative to the float conduit 24 to permit closure of fluid flow between the reservoir and the lens cavity 25. The rotatably mounted valve rod 27 and the valve rod bore 28 is indicated in FIG. 6 in alignment relative to the float conduit 24 permitting fluid flow through the float conduit.

Figure 7:
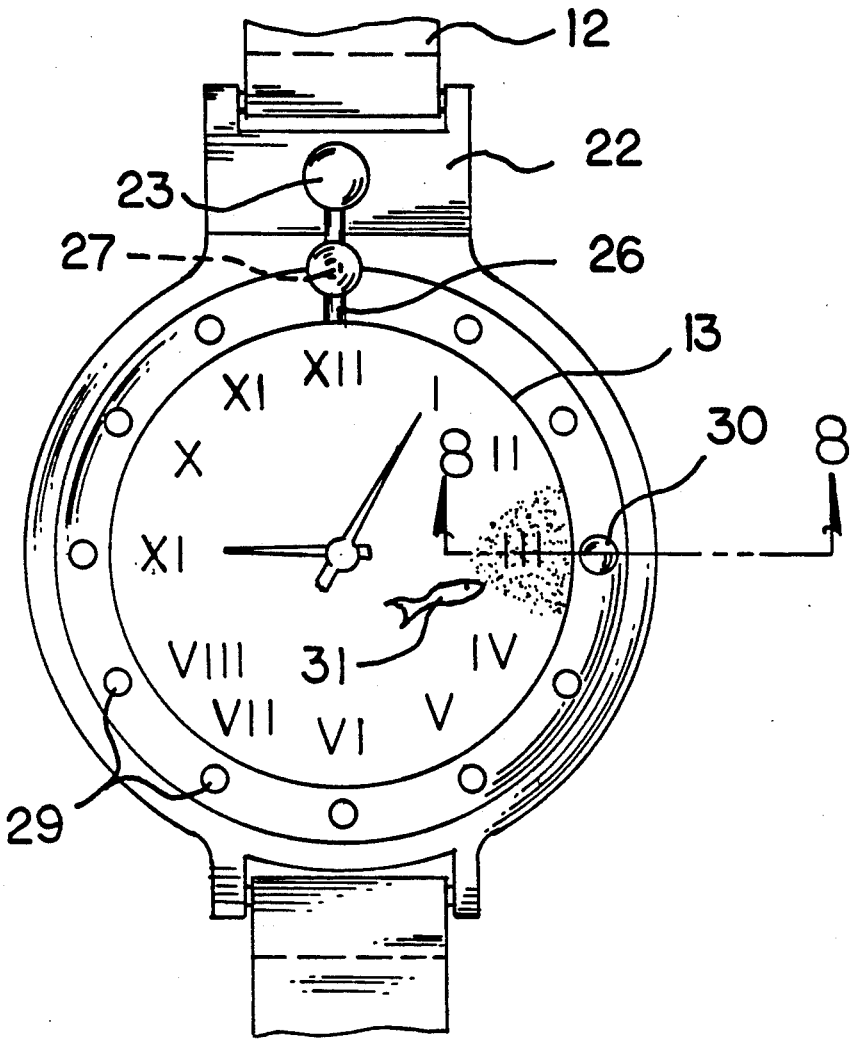
FIG. 7 is an orthographic top view of a further modified aspect of the watch housing structure.
Figure 8:
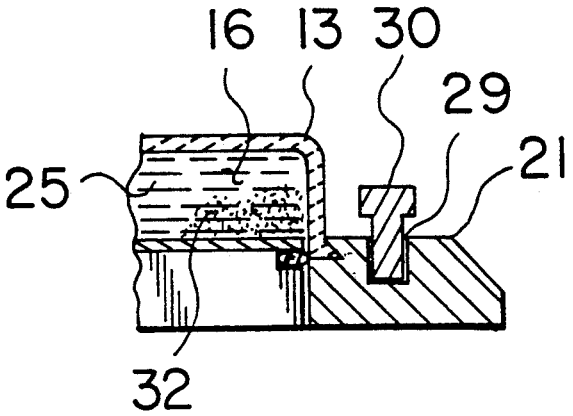
FIG. 8 is an orthographic view, taken along the lines 8—8 of FIG. 7 in the direction indicated by the arrows.

The housing of the watch is arranged in FIGS. 7 and 8 to further include an annular array, of blind bores 29 directed into the top wall 21 in surrounding relationship relative to the transparent lens 13 and the cavity 25. Each of the bores 29 is arranged for reception of a magnetic rod 30, as indicated in FIG. 9 and FIG. 7, wherein a ferrous metallic indicator 31 is arranged within the cavity 25 floatatingly and as such is attracted to the magnetic rod 30, as well as the use of ferrous metallic particles 32. The use of the rods is arranged to provide for the particles to be directed throughout the fluid 16 as well as the cavity 25, and further may be employed as an indicator relative to a predetermined time as a signal as to attaining a predetermined time relative to an event for an individual.

As to the manner of usage and operation of the instant invention, the same should be apparent from the above disclosure, and accordingly rio further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid filled watch apparatus, comprising, a watch housing, the watch housing including a housing top wall and a watch face mounted to the top wall, including an annular array of time indicator positions, with an output shaft directed through the top wall, having the indicator hands mounted to the shaft exteriorly of the housing, and a transparent lens positioned over the watch face, and a lens cavity defined between the lens and the watch face and the lens cavity containing a fluid immersing said indicator hands therewithin.

2. An apparatus as set forth in claim 1 wherein said fluid is a chemiluscent fluid.

3. An apparatus as set forth in claim 2 including a first annular seal oriented at an interface of the lens and the top wall, and a second annular seal mounted in sealing relationship between the output shaft and the top wall.

4. An apparatus as set forth in claim 3 including a fluid reservoir mounted to the housing top wall, the fluid reservoir including a fill cap therewithin, and a float conduit in fluid communication between the fluid reservoir and the lens cavity.

5. An apparatus as set forth in claim 4 wherein the fluid conduit includes a valve housing, the valve housing including a rotatable valve rod directed through the valve housing directing selective fluid flow between the reservoir and the lens cavity, and the valve rod including a valve rod bore arranged for selective alignment within the float conduit to permit selective fluid flow therethrough.

6. An apparatus as set forth in claim 5 including an annular array of blind bores directed into the top wall in surrounding relationship relative to the lens, and at least one magnetic rod arranged for reception within one of said blind bores, and a ferrous metallic indicator member arranged within the lens cavity within the chemiluscent fluid for magnetic attraction to said magnetic rod.

* * * * *